US006834655B1

(12) United States Patent
Briscoe

(10) Patent No.: US 6,834,655 B1
(45) Date of Patent: Dec. 28, 2004

(54) FOOT-CARE ACCESSORY KIT

(76) Inventor: Vanessa Briscoe, 4520 Scenic Hills Dr., Franklin, TN (US) 37064

( * ) Notice: Subject to any disclaimer, the term of this patent is extended or adjusted under 35 U.S.C. 154(b) by 0 days.

(21) Appl. No.: 10/654,758

(22) Filed: Sep. 5, 2003

(51) Int. Cl.[7] ..... A45D 33/32; F21V 33/00
(52) U.S. Cl. ..... 132/288; 362/136; 362/139
(58) Field of Search ..... 132/286, 288, 132/316, 312; 600/248; 359/882; 362/128, 129, 136, 139, 234, 138, 140

(56) References Cited

U.S. PATENT DOCUMENTS 1,651,898 A * 12/1927 Maillard ..... 132/288
4,119,107 A * 10/1978 Pinzone et al. ..... 132/316
4,688,861 A * 8/1987 Culver ..... 312/223.5
5,043,852 A * 8/1991 Gerstenberger ..... 362/129
5,072,511 A 12/1991 Ro
5,163,200 A 11/1992 Carlin et al.
5,283,696 A 2/1994 Lanser et al.
5,287,863 A 2/1994 La Joie et al.
5,343,882 A 9/1994 Iannone
5,832,941 A * 11/1998 Murillo ..... 132/316
5,959,792 A * 9/1999 Ibrahim ..... 359/872
6,193,386 B1 * 2/2001 Reynolds ..... 362/109
6,206,192 B1 3/2001 Winstead et al.
6,273,575 B1 8/2001 Downs et al.
6,598,992 B1 * 7/2003 Ames ..... 362/138
2002/0108627 A1 8/2002 Nuzzo

* cited by examiner

*Primary Examiner*—Todd E. Manahan

(57) ABSTRACT

A foot-care accessory kit includes a portable carrying case for housing a mirror having substantially the shape of a human foot. The mirror includes a threaded female portion connected thereto and a plurality of light bulbs disposed about the perimeter of the mirror that may emit light in a vertical direction upwardly from the mirror. An elongated mirror handle has a threaded male portion removably attachable to the threaded female portion of the mirror and includes a pivot mechanism for positioning the mirror at various angles. Such a handle enables a user to inspect the lower appendages of his/her foot without needing to bend over. The carrying case includes a plurality of compartments and bands for storing and maintaining a variety of foot care products and tools to aid in the treatment of a foot infection.

12 Claims, 3 Drawing Sheets

FOOT-CARE ACCESSORY KIT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

TECHNICAL FIELD

This invention relates to the general art of personal hygiene, particularly the field of foot care and, more particularly, to a portable foot inspection and care kit.

PRIOR ART

Many people suffer various foot-related ailments. These ailments range in severity from minor irritations to major dermatological problems. Most foot infections occur between the toes and/or between the toes and the front of the sole of the foot. These areas are sometimes hard to reach and it may be difficult for some people, especially elderly or overweight people, to inspect such areas. If treatment is needed, it may be difficult for such people to place sufficient amounts of medication on the affected areas.

Diabetic persons are particularly vulnerable to foot infection and the resulting foot ulcers. Because of blood circulation problems caused by their disease, diabetics must be especially diligent in caring for their feet. Many diabetics gradually lose feeling in their feet and may develop foot ulcers without even being aware of their presence until they have become infected. Early detection of these foot ulcers and other foot infections is essential to preventing a severe case of ulceration that may ultimately lead to amputation of the affected extremity. Providing all necessary tools in one convenient, portable kit would address the problems many diabetics experience as a result of not having the correct equipment, instructions, and resources concerning foot care, and thereby enhance the foot care and the overall health of diabetics and others with foot problems.

Accordingly, a need remains for a portable, sanitary kit that contains tools, supplies, and medication necessary for the inspection and treatment of a human foot.

BRIEF SUMMARY OF THE INVENTION

In view of the foregoing background, it is therefore an object of the present invention to provide a kit for the inspection and treatment of a human foot. These and other objects, features, and advantages of the invention are provided by a portable foot-care accessory kit including a carrying case having a bottom surface that houses a mirror connected thereto for viewing the bottom surface of a foot. The mirror preferably has a shape substantially similar to the shape of a human foot and includes a threaded female portion connected to a perimeter thereof. A plurality of light bulbs are disposed about a perimeter of the mirror and spaced from each other. The plurality of light bulbs emit light in a substantially vertical direction upwardly from the mirror.

The accessory kit further includes an elongated mirror handle having a threaded male end portion removably attachable to the threaded female portion of the mirror and a mechanism for pivotally moving the mirror handle when same is connected to the threaded female portion so that a user can inspect the lower appendages of a foot. Advantageously, a user does not have to repeatedly bend over to view the lower portion of his/her foot.

The accessory kit further includes a plurality of compartments selectively defined within the carrying case, a plurality of bands connected to a top surface of the carrying case, and a mechanism for selectively fastening the top and bottom surfaces to each other. To assist in transporting the accessory kit, a handle having opposed end portions is connected to the exterior surface of the carrying case. A plurality of foot-care products are preferably disposed within the carrying case and maintained by the plurality of compartments and bands, respectively.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
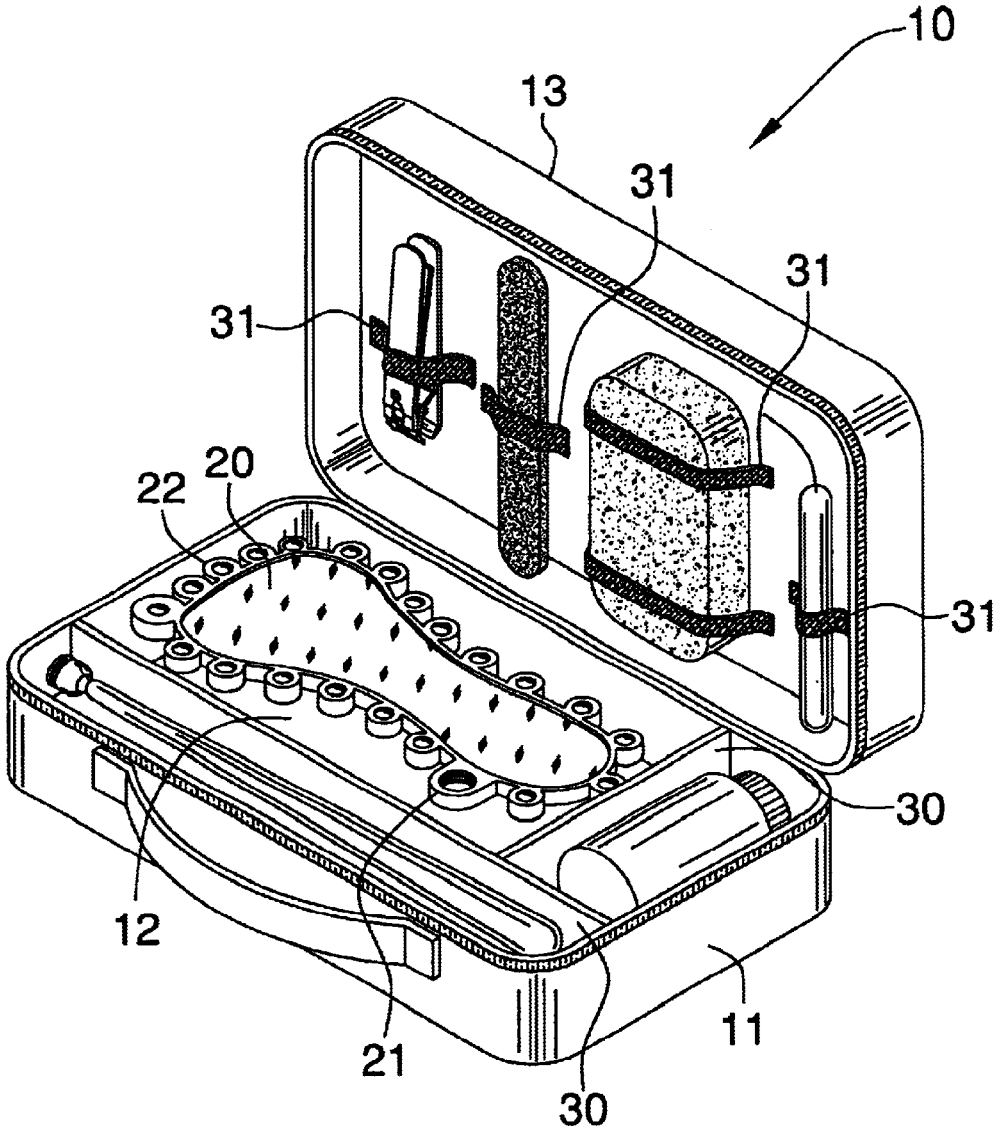
FIG. 1 is a perspective view showing an accessory kit for foot care, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

The accessory kit of this invention is referred to generally in FIGS. 1–4 by the reference numeral 10 and is intended to provide a portable foot-care accessory kit. It should be understood that the accessory kit 10 may be used to store and transport many different types of materials and objects and should not be limited to foot-care products.

Initially referring to FIG. 1, the accessory kit 10 includes a carrying case 11 with a bottom surface 12 that houses a mirror 20 connected thereto. The mirror 20 has a shape substantially similar to the shape of a human foot and includes a threaded female portion 21 connected to the perimeter thereof. A plurality of light bulbs 22, emitting light in a substantially vertical direction upwardly from the mirror 20, are disposed about the perimeter of thereof and are spaced apart from each other. The light emitted upwardly from the mirror enables a user to illuminate the surface to be examined. Of course, such light bulbs 22 are powered by a conventional power source disposed within the carrying case 11, as well known to a person of ordinary skill in the art.

Figure 3:
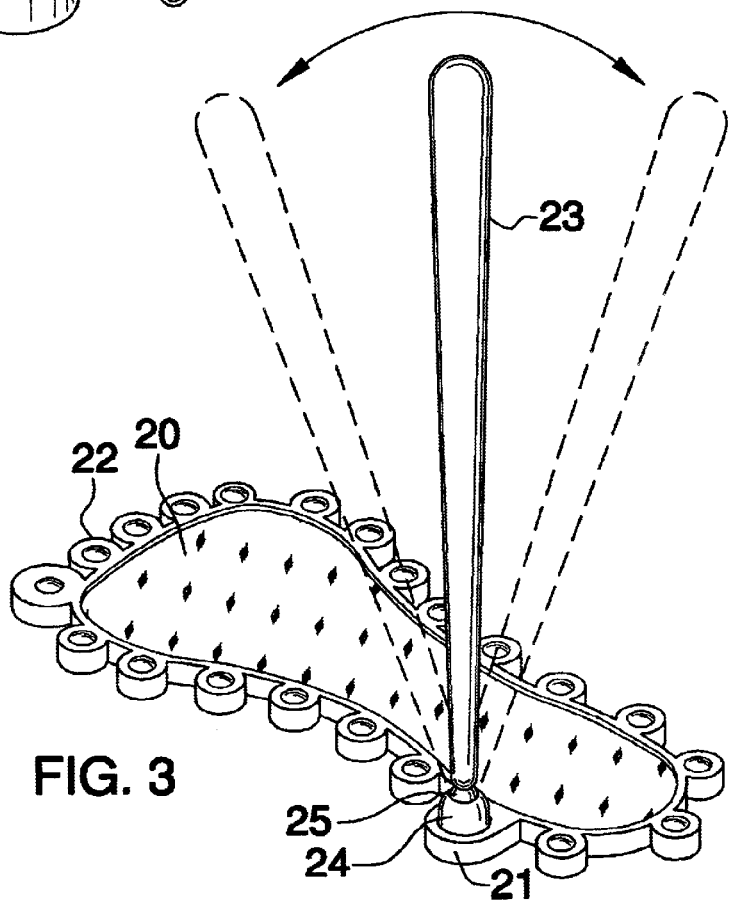
FIG. 3 is a perspective view showing the mirror and mirror handle pivotable between alternate positions.

Now referring to FIG. 3, the accessory kit 10 further includes an elongated mirror handle 23 having a threaded male end portion 24 removably attachable to the threaded female portion 21 of the mirror 20 and a pivot mechanism 25 for moving the mirror 20 when the handle 23 is connected to the threaded female portion 21 of the mirror 20. Advantageously, a single user can inspect the lower appendages and bottom of his/her foot without requiring assistance from another person or having to repeatedly bend over. Advantageously, the pivot mechanism 25 enables a single user to position the mirror 20 at varying angles for a more thorough inspection of a foot. Such a pivot mechanism 25 may include a conventional ball-and-socket joint as well known in the art, for example.

Figure 2:
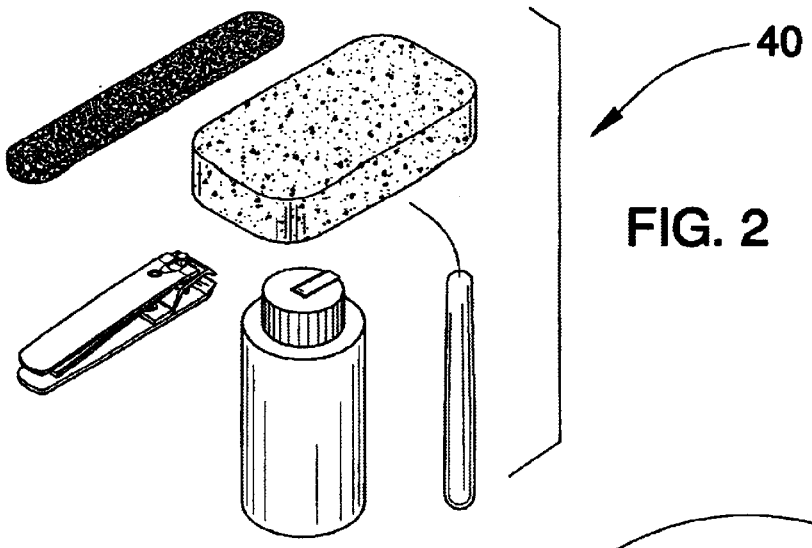
FIG. 2 is a perspective view showing a plurality of foot care products.

Now referring back to FIG. 1 and to FIG. 2, the accessory kit 10 further includes a plurality of compartments 30 selectively defined within the carrying case 11 and a plurality of bands 31, preferably formed from elastic material, connected to the top surface 13 of the carrying case 11 for storing and maintaining a plurality of foot-care products 40 for treatment of various foot ailments. Of course, a variety of foot-care products may be included such as a conventional bottle of foot powder for helping to reduce the likelihood of fungal infections, for example. Such a foot powder is preferably applied between the toes, as well known in the art.

Figure 4:
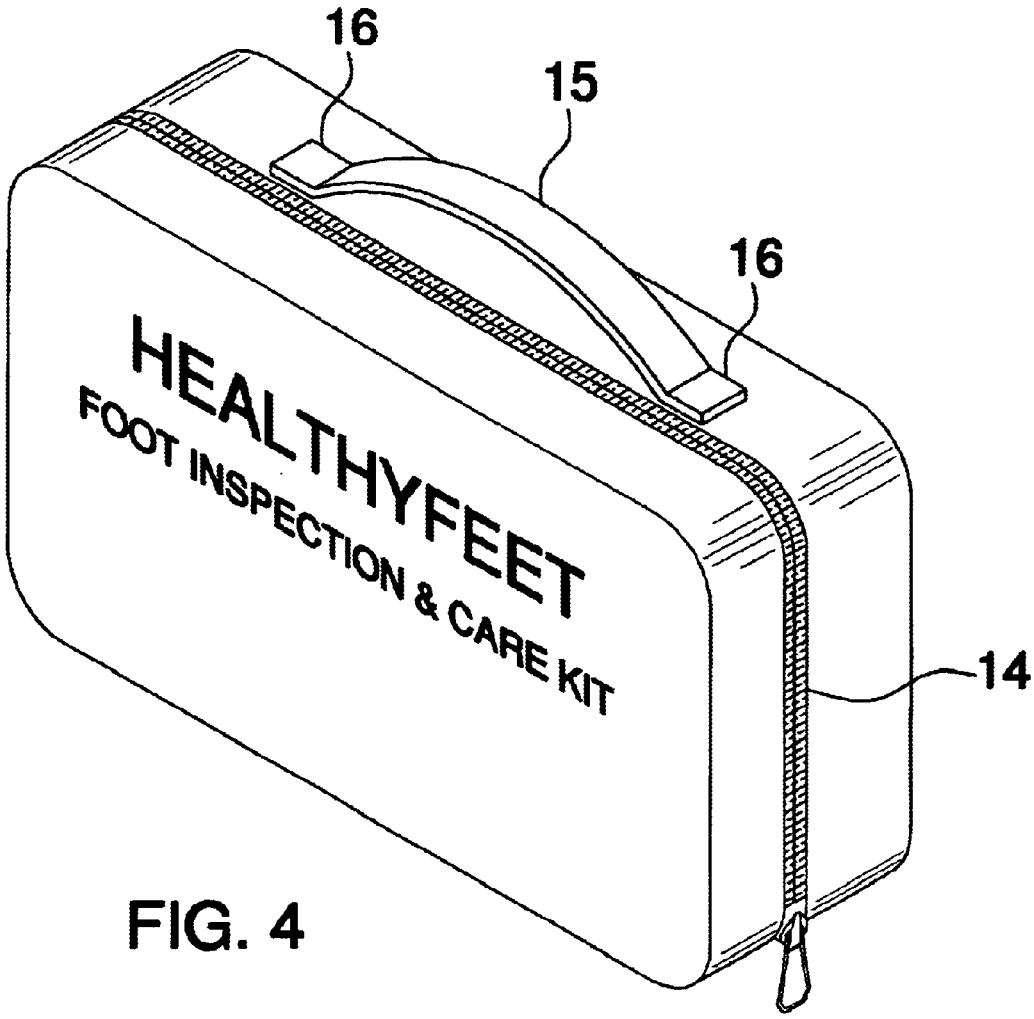
FIG. 4 is a perspective view showing the carrying case.

The carrying case 11 includes a mechanism 14 for selectively fastening the top 13 and bottom 12 surfaces to each other and a handle 15 having opposed end portions 16 connected to an exterior surface of the carrying case 11, as perhaps best shown by FIG. 4. Of course, mechanism 14 may include a conventional zipper or Velcro strap as well known in the industry, for example. The elasticity of the bands 31 enables the carrying case 11 to accommodate a variety of tools and foot-care products 40 as selected by the user.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A foot-care accessory kit comprising:

a carrying case having a bottom surface and housing a mirror connected thereto and for allowing a bottom surface of a foot to be viewed, said mirror including a threaded female portion connected to a perimeter thereof;

a plurality of light bulbs disposed about a perimeter of said mirror and being spaced from each other, said plurality of light bulbs emitting light in a substantially vertical direction upwardly from said mirror;

a plurality of compartments selectively defined within said carrying case and a plurality of bands connected to a top surface of said carrying case;

an elongated mirror handle having a threaded male end portion removably attachable to said threaded female portion; and means for pivotally moving said mirror when said mirror handle is pivoted in a corresponding direction after same is connected to said threaded female portion so that a user can inspect lower appendages of a foot.

2. The accessory kit of claim 1, further comprising means for selectively fastening said top and bottom surfaces to each other.

3. The accessory kit of claim 1, further comprising a plurality of foot-care products disposed within said carrying case and maintained by said plurality of compartments and bands respectively.

4. The accessory kit of claim 1, further comprising a handle having opposed end portions connected to an exterior surface of said carrying case.

5. The accessory kit of claim 1, wherein said mirror has a shape substantially similar to a shape of a human foot.

6. A foot-care accessory kit comprising:

a carrying case having a bottom surface and housing a mirror connected thereto and for allowing a bottom surface of a foot to be viewed, said mirror including a threaded female portion connected to a perimeter thereof;

a plurality of light bulbs disposed about a perimeter of said mirror and being spaced from each other, said plurality of light bulbs emitting light in a substantially vertical direction upwardly from said mirror;

a plurality of compartments selectively defined within said carrying case and a plurality of bands connected to a top surface of said carrying case;

an elongated mirror handle having a threaded male end portion removably attachable to said threaded female portion;

means for pivotally moving said first mirror when said mirror handle is pivoted in a corresponding direction after same is connected to said threaded female portion so that a user can inspect lower appendages of a foot; and means for selectively fastening said top and bottom surfaces to each other.

7. The accessory kit of claim 6, further comprising a plurality of foot-care products disposed within said carrying case and maintained by said plurality of compartments and bands respectively.

8. The accessory kit of claim 6, further comprising a handle having opposed end portions connected to an exterior surface of said carrying case.

9. The accessory kit of claim 6, wherein said mirror has a shape substantially similar to a shape of a human foot.

10. A foot-care accessory kit comprising:

a carrying case having a bottom surface and housing a mirror connected thereto and for allowing a bottom surface of a foot to be viewed, said mirror including a threaded female portion connected to a perimeter thereof;

a plurality of light bulbs disposed about a perimeter of said mirror and being spaced from each other, said plurality of light bulbs emitting light in a substantially vertical direction upwardly from said mirror; said mirror having a shape substantially similar to a shape of a human foot;

a plurality of compartments selectively defined within said carrying case and a plurality of bands connected to a top surface of said carrying case;

an elongated mirror handle having a threaded male end portion removably attachable to said threaded female portion;

means for pivotally moving said mirror when said mirror handle is pivoted in a corresponding direction after same is connected to said threaded female portion so that a user can inspect lower appendages of a foot; and means for selectively fastening said top and bottom surfaces to each other.

11. The accessory kit of claim 10, further comprising a plurality of foot-care products disposed within said carrying case and maintained by said plurality of compartments and bands respectively.

12. The accessory kit of claim 10, further comprising a handle having opposed end portions connected to an exterior surface of said carrying case.

* * * * *